US010325466B2

(12) United States Patent
Cleary

(10) Patent No.: US 10,325,466 B2
(45) Date of Patent: Jun. 18, 2019

(54) SECURITY MARKING SYSTEM

(71) Applicant: SmartWater Limited, London, Greater London (GB)

(72) Inventor: Phil Cleary, London (GB)

(73) Assignee: SmartWater Limited, London, Greater London (GB)

( * ) Notice: Subject to any disclaimer, the term of this patent is extended or adjusted under 35 U.S.C. 154(b) by 0 days.

(21) Appl. No.: 16/085,158

(22) PCT Filed: Mar. 15, 2017

(86) PCT No.: PCT/GB2017/050707

§ 371 (c)(1),
(2) Date: Sep. 14, 2018

(87) PCT Pub. No.: WO2017/158353

PCT Pub. Date: Sep. 21, 2017

(65) Prior Publication Data

US 2019/0080576 A1 Mar. 14, 2019

(30) Foreign Application Priority Data

Mar. 15, 2016 (GB) ..... 1604409.1

(51) Int. Cl.
*G08B 15/02* (2006.01)
*G08B 13/196* (2006.01)

(52) U.S. Cl.
CPC ..... *G08B 15/02* (2013.01); *G08B 13/19641* (2013.01); *G08B 13/19656* (2013.01); *G08B 13/19695* (2013.01); *G08B 13/19697* (2013.01)

(58) Field of Classification Search
CPC .... G08B 5/40; G08B 15/02; G08B 13/19641; G08B 13/19695; G08B 13/19697
See application file for complete search history.

(56) References Cited

U.S. PATENT DOCUMENTS 9,262,901 B1 * 2/2016 Mona ..... G08B 15/02
2009/0121861 A1 5/2009 Latham et al.
2012/0325127 A1 12/2012 Adrain

FOREIGN PATENT DOCUMENTS

CN 204425492 U 6/2015
WO WO0201531 A1 1/2002
(Continued)

OTHER PUBLICATIONS

ISA/EP, International Search Report and Written Opinion for PCT Patent Application No. PCT/GB2017/050707, dated Jun. 22, 2017.
(Continued)

*Primary Examiner* — Curtis B Odom
(74) *Attorney, Agent, or Firm* — NK Patent Law

(57) ABSTRACT

A method of security marking, in a system which includes one or more marker deployment devices, each marker deployment device for deploying a marker liquid in a corresponding deployment region, and one or more sensors, each sensor for detecting activity within a corresponding sensor detection region, wherein each marker deployment region overlaps one or more sensor detection regions at least partially and wherein for each marker deployment region the overlapping one or more sensor detection regions include at least one sensor detection region corresponding to a sensor capable of recording video.

20 Claims, 4 Drawing Sheets

(56) References Cited

FOREIGN PATENT DOCUMENTS

| | | | |
|---|---|---|---|
| WO | WO03088156 | A2 | 10/2003 |
| WO | WO2006071123 | A1 | 7/2006 |
| WO | WO2009078013 | A2 | 6/2009 |

OTHER PUBLICATIONS

WIPO, International Preliminary Report on Patentability for PCT Patent Application No. PCT/GB2017/050707, dated Sep. 18, 2018.

* cited by examiner

SECURITY MARKING SYSTEM

CROSS REFERENCE TO RELATED APPLICATIONS

This application is a U.S. National Stage application of International Application No. PCT/GB2017/050707 filed on Mar. 15, 2017, which claims the benefit of UK Patent Application No. 1604409.1 filed on Mar. 15, 2016, the entire content of all of which is incorporated by reference herein.

FIELD OF THE INVENTION

The present invention relates to a security marking system.

BACKGROUND

Burglary and theft from premises is an on-going problem. There have been many technological developments directed towards reducing or discouraging burglary. For example WO 03088156 A2 describes a portable security apparatus including data collecting means for collecting data from at least one location marker and further including means for communicating the data to a remote site.

WO 0201531 A1 describes an alarm system including a number of alarm subscribers, which in e.g. their homes have sensors communicatively coupled to a collecting unit or a router/switch. The collecting unit or the router/switch is communicatively coupled to an externally arranged central alarm server. At an alarm signal from any of the sensors, the collecting unit or the router will send an alarm signal to the central alarm server, which unit after a certain alarm delay transmits the alarm further to a number of alarm receivers and/or central alarm unit defined by the subscriber.

However, burglary remains a difficult crime to solve, and rates of conviction of offenders and recovery of property remain low. For example, there is an inevitable delay between the detection of an intruder by an alarm or such system within a given property and the arrival of the police in response to the alarm. This represents a window of opportunity for the offender to get into and out of a property with whatever they can take with no fear of apprehension.

In order to obtain better evidence to help convict burglars and recover property, many solutions have been developed which allow a user to remotely control and view cameras placed in their property, see for example CN 204425492 U and WO 2006071123 A1.

However, burglars may easily conceal their features using hats or masks, which can make it difficult to conclusively establish the identity of an intruder even when the property owner is able to remotely view the crime and record footage. Additionally, stolen property is often sold quickly for cash and can be difficult to trace and to conclusively establish ownership of the property to allow for recovery.

SUMMARY

According to a first aspect of the invention there is provided a method of security marking, in a system which includes one or more marker deployment devices, each marker deployment device for deploying a marker liquid in a corresponding deployment region, and one or more sensors, each sensor for detecting activity within a corresponding sensor detection region, wherein each marker deployment region overlaps one or more sensor detection regions at least partially and wherein for each marker deployment region the overlapping one or more sensor detection regions include at least one sensor detection region corresponding to a sensor capable of recording video. The method includes receiving a signal from a sensor which has detected activity and attempting to establish communication with a remote device. The method also includes, in dependence upon communication with the remote device is established and connection bandwidth is sufficient to transmit a video signal, transmitting a video signal to the remote device, the video signal showing at least part of a marker deployment region proximate to the activated sensor. The method also includes, in dependence upon receiving a deployment signal from the remote device, activating one or more marker deployment devices designated by the deployment signal.

Thus, a property owner or responsible person can view an intruder and use marker deployment devices to apply the marker liquid to the intruder and/or to valuable property. This can be done using remote activation. The deployment of the marker may allow the intruder to be identified if the marker touches their skin or any clothing not subsequently disposed of. The deployment of the marker may make it easier to identify and recover stolen property.

The determination of which sensor detection regions overlap with or are proximate to each which marker deployment region may be predetermined during installation or modification of the system. A sensor detection region may be considered to be proximate to a marker deployment region is they are within a set distance, for example 1, 2, 5 or 10 meters. A sensor detection region may be considered to be proximate to a marker deployment region if the sensor detection region corresponds to a part of or an entrance to a room or area and the marker deployment region is in the room or area. A sensor detection region may be considered to be proximate to a marker deployment region if the marker deployment region corresponds to a part of or an entrance to a room or area and the sensor detection region is in the room or area.

The method may also include, in dependence upon communication with the remote device is not established within a first predetermined duration or communication is established and connection bandwidth is insufficient to transmit a video signal, operating all marker deployment devices according to local control.

The method may also include, in dependence upon communication with the remote device is established and connection bandwidth is sufficient to transmit a video signal, and in dependence upon receiving no signal from the remote device within a second predetermined duration or upon the connection bandwidth becoming insufficient to transmit a video signal for a duration exceeding the first predetermined duration, operating all marker deployment devices according to local control.

The second predetermined duration may be longer than the first predetermined duration. For example, the first predetermined duration may be in the range from 5 to 60 seconds, whereas the second predetermined duration may be up to 5 minutes.

Local control of a marker deployment device may include, for each marker deployment device, in dependence upon receiving a signal from a sensor which has detected activity and which corresponds to a sensor region overlapping with or proximate to the marker deployment region, activating the marker deployment device.

Thus, if a connection with suitable bandwidth for video streaming and manual deployment control cannot be obtained or sustained, the marker deployment devices may be reverted to local automatic control.

The method may also include, in dependence upon communication with the remote device is established and connection bandwidth is sufficient to transmit a video signal, ceasing transmission of the video signal in dependence upon receiving a cancellation signal from the remote device.

Thus, a property owner or responsible person may stand-down an alarm or alert if they can confirm from the transmitted video that there is no intruder.

The method may also include, in dependence upon receiving a viewpoint change signal from the remote device designating a sensor which is capable of transmitting video, transmitting the video signal from the designated sensor to the remote device. The method may also include resetting a timer for comparison against the second predetermined duration.

Some or all sensors which are capable of providing video signals may also be capable of performing pan, rotate or zoom operations. The method may further include, in dependence upon receiving a viewpoint change signal from the remote device including one or more pan, rotate and/or zoom commands, transmitting a signal to the sensor providing the video signal to execute any pan, rotate or zoom commands included in the viewpoint switch signal, and resetting a timer for comparison against the second predetermined duration.

The system may include a plurality of marker deployment devices and a subset of marker deployment devices may be pre-designated as rapid activation deployment devices, wherein the deployment region of each rapid activation deployment device overlaps with or is proximate to at least one sensor detection region corresponding to a sensor which is not capable of transmitting video. The method may also include, in dependence upon receiving a signal from a sensor which has detected activity and which corresponds to a marker deployment device designated as a rapid activation deployment device, activating that marker deployment device.

The system may include a proximity sensor corresponding to each marker deployment device and the sensor detection region of each proximity sensor may overlap the respective marker deployment region. The proximity sensor may be provided in a single unit with the corresponding marker deployment device.

Each sensor may include one or more of a camera, a proximity sensor, a motion sensor, an infra-red sensor, a pyroelectric sensor, an acoustic sensor such as a microphone, an ultrasonic sensor such as one or more piezoelectric transducers, a magnetic switch, a pressure switch and/or a mechanical switch. A magnetic switch, a pressure switch or a mechanical switch may be configured to provide a signal indicating activity in response to a door or window being opened. A pressure switch may be configured to provide a signal indicating activity in response to removal of an object placed on the pressure switch. A camera may be configured to provide a signal indicating activity in dependence upon a motion detection algorithm applied to the video signal, or when the video signal is compressed by reference to previous frames in dependence upon a bit-rate of the video signal. A camera may be sensitive to visual and/or infra-red wavelengths.

When a sensor takes the form of a camera, the corresponding sensor detection region may be the visual field of the camera. When a sensor takes the form of a proximity sensor a motion sensor, an infra-red sensor or a pyroelectric sensor, the corresponding sensor detection region may be a region or volume in front of the sensor. When a sensor takes the form of an acoustic sensor, the sensor detection region may include any region in which an audible sound may be detected by the acoustic sensor. When a sensor takes the form of an ultrasonic sensor, the corresponding sensor detection volume may be one of more beams or cones extending from ultrasonic transducers. When a sensor takes the form of a magnetic switch, a pressure switch or a mechanical switch, the corresponding sensor detection volume may be a door or window which may be opened or an object which is removable.

The system may include at least one audio output device, and the method may include receiving an audio signal from the remote device, and playing the audio signal through the at least one audio output device.

According to a second aspect of the invention there is provided a hub for a security marking system including a deployment interface module configured to communicate with one or more marker deployment devices, each marker deployment device for deploying a marker liquid in a corresponding deployment region. The hub for a security marking system also includes a sensor interface module configured to communicate with one or more sensors, each sensor for detecting activity within a corresponding sensor detection region. The hub for a security marking system also includes a network interface configured to communicate with external networks. The hub for a security marking system also includes a controller configured to control the sensor interface, marker interface and network interface. Each marker deployment region overlaps one or more sensor detection regions at least partially and, for each marker deployment region, the overlapping one or more sensor detection regions include at least one sensor detection region corresponding to a sensor capable of transmitting video. The controller is configured to receive a signal indicating that a sensor has detected activity, and to attempt to establish communication with a remote device. The controller is configured to, in dependence upon communication with the remote device is established and connection bandwidth is sufficient to transmit a video signal, transmit a video signal to the remote device, the video signal showing at least part of a marker deployment region proximate to the activated sensor. The controller is configured to, in dependence upon receiving a deployment signal from the remote device, activate one or more marker deployment devices designated by the deployment signal.

The controller may be configured to, in dependence upon communication with the remote device not being established within a first predetermined duration or communication being established and connection bandwidth being insufficient to transmit a video signal, operate all marker deployment devices according to local control.

The controller may be configured to, in dependence upon communication with the remote device is established and connection bandwidth is sufficient to transmit a video signal, and in dependence upon receiving no signal from the remote device within a second predetermined duration or upon the connection bandwidth becoming insufficient for longer than the first predetermined duration, operate all marker deployment devices according to local control.

When marker deployment devices are under local control, the controller may be configured to, for each marker deployment device, in dependence upon receiving a signal from a sensor which has detected activity and which corresponds to a sensor region overlapping with or proximate to the marker deployment region, activate the marker deployment device.

The controller may be configured to, in dependence upon communication with the remote device being established and connection bandwidth being sufficient to transmit a video signal, cease transmission of the video signal in dependence upon receiving a cancellation signal from the remote device.

The hub for a security marking system may also include a battery for providing power when an external power supply is unavailable.

The deployment interface module may be configured to communicate with a plurality of marker deployment devices and the controller may be configured to store the identities of a subset of marker deployment devices which are pre-designated as rapid activation deployment devices. The deployment region of each rapid deployment device may overlap with or may be proximate to at least one sensor detection region corresponding to a sensor which is not capable of transmitting video. The controller may be configured to, in dependence upon receiving a signal from a sensor that has detected activity in a sensor detection region corresponding to a marker deployment device designated as a rapid activation deployment device, activate that marker deployment device.

The sensor interface module may communicate with some or all of the sensor(s) through a security alarm system which controls and/or monitors some or all of the sensors.

The deployment interface module may be configured to communicate with the marker deployment devices using wired and/or wireless communication means. The sensor interface module may be configured to communicate with the sensors using wired and/or wireless communication means. The deployment interface module (sensor interface module) may be configured to communicate with the marker deployment devices (sensors) using Ethernet, Firewire®, WiFi, Bluetooth®, ZigBee® or using power-line communications.

A security marking system may include the security marking hub, one or more marker deployment devices, each marker deployment device for deploying a marker liquid in a corresponding deployment region, and one or more sensors, each sensor for detecting activity within a corresponding sensor detection region. Each marker deployment region may overlap one or more sensor detection regions at least partially, and for each marker deployment region, the overlapping one or more sensor detection regions may include at least one sensor detection region corresponding to a sensor capable of transmitting video.

A sensor may include one or more of a camera, a proximity sensor, a motion sensor, an infra-red sensor, a pyroelectric sensor, an acoustic sensor, an ultrasonic sensor, a magnetic switch, a pressure switch and/or a mechanical switch.

The system may only include sensors in the form of cameras. Signal(s) indicating detection of activity may be provided by one or more cameras detecting motion in a respective field of view.

The system may include, for each deployment device, a camera having a corresponding field of view which overlaps the respective deployment region and at least one further sensor which is not capable of transmitting video and having a corresponding sensor detection region which overlaps with or is proximate to the respective deployment region. Signal(s) indicating detection of activity may be provided only by sensors which are not capable of transmitting video. Signal(s) indicating detection of activity may be provided by sensors which are not capable of transmitting video and/or by one or more cameras.

The system may include a plurality of deployment devices. Each of the deployment devices may correspond to a camera having a field of view overlapping the respective deployment volume and at least some of the deployment devices may correspond to at least one further sensor which is not capable of transmitting video and having a sensor detection region which overlaps with or is proximate to the respective deployment region. Signal(s) indicating detection of activity may be provided only by sensors which are not capable of transmitting video. Signal(s) indicating detection of activity may be provided by sensors which are not capable of transmitting video and/or by one or more cameras.

The system may include one or more deployment devices. Each of the deployment devices may correspond to a camera having a field of view overlapping the respective deployment volume. The system may also include one or more sensors in the form of switches arranged to detect the opening of one or more doors and/or windows of a building or area. The system may also include one or more sensors in the form of proximity sensors and/or motion sensors, each of which corresponds to a sensor detection volume which is a room or a region of the building or area. Signal(s) indicating detection of activity may be provided only by switches and/or proximity and/or motion sensors. Signal(s) indicating detection of activity may be provided by switches and/or proximity and/or motion sensors and/or cameras. The switches and/or proximity sensors and/or motion sensors may form part of a separate alarm system to which the security marking system may be communicatively coupled.

The security marking system may include at least one audio output device.

A building or a portion of a building may include the security marking system. A vehicle or a portion of a vehicle may include the security marking system.

According to a third aspect of the invention there is provided a non-transitory computer readable medium storing instructions which, when executed by a data processing apparatus, cause the data processing apparatus to carry out the method of security marking.

BRIEF DESCRIPTION OF THE DRAWINGS

Certain embodiments of the present invention will now be described, by way of example, with reference to the accompanying drawings in which.

DETAILED DESCRIPTION

Figure 1:
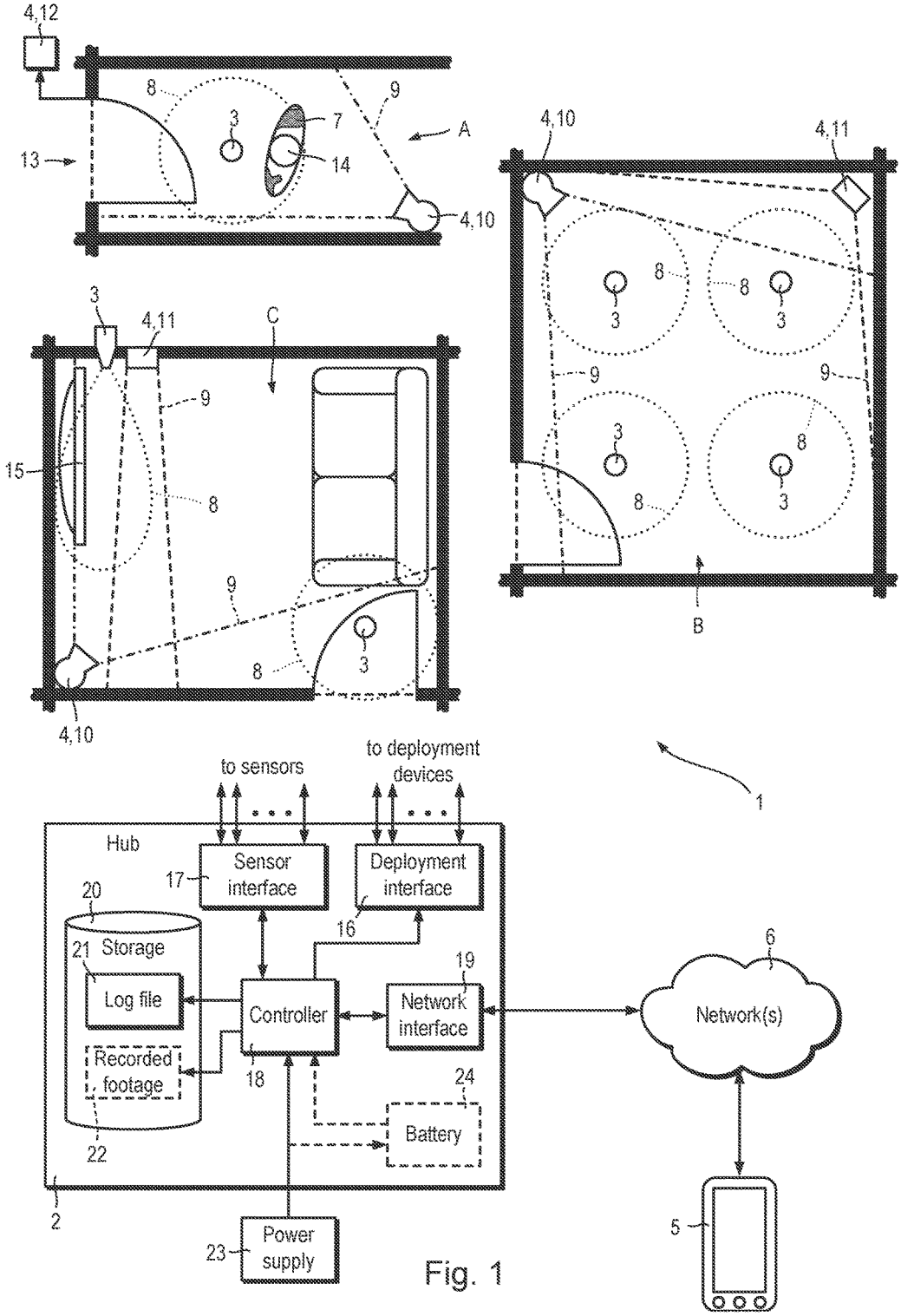
FIG. 1 shows a schematic overview of a security marking system.

Referring to FIG. 1, a security marking system 1 includes a hub 2, one or more marker deployment devices 3 and one or more sensors 4. A remote device 5 may communicated with the hub 2 via one or more networks 6.

The security marking system may be provided in any location to which there is no or limited public right of access including, without limitation, residential properties such as a house or an apartment or parts thereof or places of business or parts thereof including, without limitation, offices, warehouses, shops, showrooms and factories. The security marking system may be provided in a public or governmental buildings or properties or parts thereof. The security marking system may be deployed in vehicles or parts thereof. The security marking system may be deployed in freight containers or parts thereof.

Each marker deployment device 3 is for deploying a marker liquid 7 in a corresponding deployment region 8. The marker liquid used in a location may be unique to that location such that any individual or object that is marked with the marker liquid may be traced back to that location.

A unique marker liquid may comprise a unique marker dissolved or dispersed in one or more solvents. The unique marker may be a unique material, for example a unique DNA sequence; a unique combination of two or more different marker compounds; or a combination of marker compounds in a unique ratio. A unique marker liquid may be formed as described in UK Patent GB 2413674, the contents of which are incorporated herein by reference. The unique combinations of marker compounds can be prepared using a binary method; however other methods comprising octal and hexadecimal strings can also be used. The component or components of each unique marker liquid may be held on a database and assigned to a specific owner and/or location.

The marker liquid may comprise a fluorescent or phosphorescent indicator to indicate the presence of a unique marker. Optionally, the marker liquid may not be visible to the naked eye (a "covert" marker). In this case an indicator, if present, may be a material that fluoresces or phosphoresces under IR or UV light. Alternatively or additionally, the marker liquid may comprise an indicator that is visible to the naked eye (an "overt" marker), optionally a pigment such as, for example, red or purple.

Each marker deployment device 3 comprises a deployment head, optionally a spray head or nozzle, for deploying the marker liquid 7 by spraying, atomising or any other suitable method for deploying the liquid in the deployment region. Marker deployment devices 3 communicate with the hub using wired or wireless connections. A temperature controller may control the temperature of the liquid, for example to prevent freezing. The temperature controller may comprise a thermometer and a heater. The thermometer may monitor atmospheric or liquid temperature and the heater may be activated if atmospheric or liquid temperature falls below a threshold value.

Each sensor 4 is for detecting activity within a corresponding sensor detection region 9. Each sensor may include one or more of a camera 10, a proximity/motion sensor 11, an infra-red sensor (not shown), a pyroelectric detector (not shown), an acoustic detector (not shown), an ultrasonic detector (not shown), a magnetic switch 12, a pressure switch (not shown) and/or a mechanical switch (not shown). The camera 10 may capture still or video data. The camera 10 may be fixed or may support additional functions such as zooming, panning and/or rotating. A sensor 4 may include multiple types of sensor 4 in a single unit, for example, a sensor 4 may include a camera 10 coupled to a proximity/motion sensor 11 for triggering the camera. Detected activity may correspond to the motion or presence of an authorised person/intruder. A camera 10 transmitting video may be configured to detect motion even when not used in combination with other sensors, for example, using a motion detection algorithm running locally on the camera 10 or on the hub 2. Alternatively, when a camera uses inter-frame compression or similar techniques to compress a video signal, a basic form of motion detection may be implemented by monitoring the bit-rate of the video signal. Sensors 4 communicate with the hub using wired or wireless connections.

Each marker deployment region 8 at least partially overlaps one or more sensor detection regions 9. For each marker deployment region 8, the overlapping one or more sensor detection regions 9 include at least one sensor detection region 9 corresponding to a sensor 4 capable of transmitting video, for example camera 10.

The security marking system 1 may also include at least one audio output device (not shown). The audio output device may be used to sound an audible warning to deter an intruder. Alternatively, the audio output device may be used to allow the operator of the remote device, for example the property owner or other responsible person, to speak directly to the intruder using the remote device 5 as explained hereinafter. An experienced intruder may not be deterred by an alarm, however live speech indicating that they are being watched and/or marked may be a more surprising and effective deterrent and cause them to leave.

It will be appreciated that a number of different configurations and applications of the security marking system 1 can be employed. For instance, example A is an access corridor extending from an exterior door 13. An intruder 14 opening the exterior door 13 causes the magnetic sensor 12 attached to the door to signal activity to the hub 2, causing the hub 2 to transmit or stream live video from the camera 10 to the remote device 5. Optionally, live audio may also be transmitted. The user of the remote device, on seeing the intruder 14 in the video shown by the remote device (FIG. 3), can send an instruction to deploy the marker liquid 7 from a deployment device 3 in the form of a nozzle or sprayer, which marks goods and/or the intruder 14. Alternatively, if the individual entering the property is an authorised individual that has failed to deactivate the sensor then the user of the remote device can refrain from activating the deployment device 3 upon recognising that individual.

In general, the security marking system 1 will be set or armed by a property owner or responsible person when they exit and secure the property. The security marking system 1 may be set or armed using, for example, a key (not shown), a keycard (not shown), an alphanumeric keypad (not shown), a thumb or fingerprint scanner (not shown) or a combination of multiple identification means. The security marking system 1 may additionally be operated as an alarm system to activate an audible alarm and/or to alert the police of private security operatives. Alternatively, the security marking system 1 may be operated in conjunction with a separate, conventional alarm system (not shown), and some or all of the sensors 4 may be provided by the alarm system.

The operation of the security marking system 1 and the interaction with the remote device 5 are explained more fully hereinafter. The deployment of the marker liquid 7 may be automatic in some instances.

In example B, a room containing valuable goods such as a stockroom, or valuable information and equipment such as a server room, is equipped with a camera 10 which may be triggered by a proximity/motion sensor 11. The camera 10 and proximity/motion sensor 11 have overlapping sensor detection areas 9. An array of marker liquid deployment devices 3 in the form of nozzles or sprayers, optionally ceiling or wall mounted sprayers, provide complete or substantially complete coverage of the room. The marker liquid deployment devices 3 may be activated manually or automatically as further described hereinafter.

In example C, a security marking system 1 may be configured to protect especially valuable possessions 15, for example a television in a domestic situation. A camera 10 in a corner of the room provides a field of vision. A proximity/motion detector 11 with a relatively narrow sensor detection region 9 is mounted to detect when an intruder 14 approaches the valuable possession 15. A marker liquid deployment device 3 in the form of a sprayer or nozzle is arranged so that the deployment region 8 encompasses the valuable possession 15 and the likely location of an intruder 14. A backup marker liquid deployment device 3 may be provided to cover the room exit, in the form of a nozzle or sprayer. The marker liquid deployment devices 3 may be activated singly or individually and manually or automatically as further described hereinafter. Manual activation from a remote location may be by a property owner or a responsible person, such as an individual in a monitoring centre.

Figure 2:
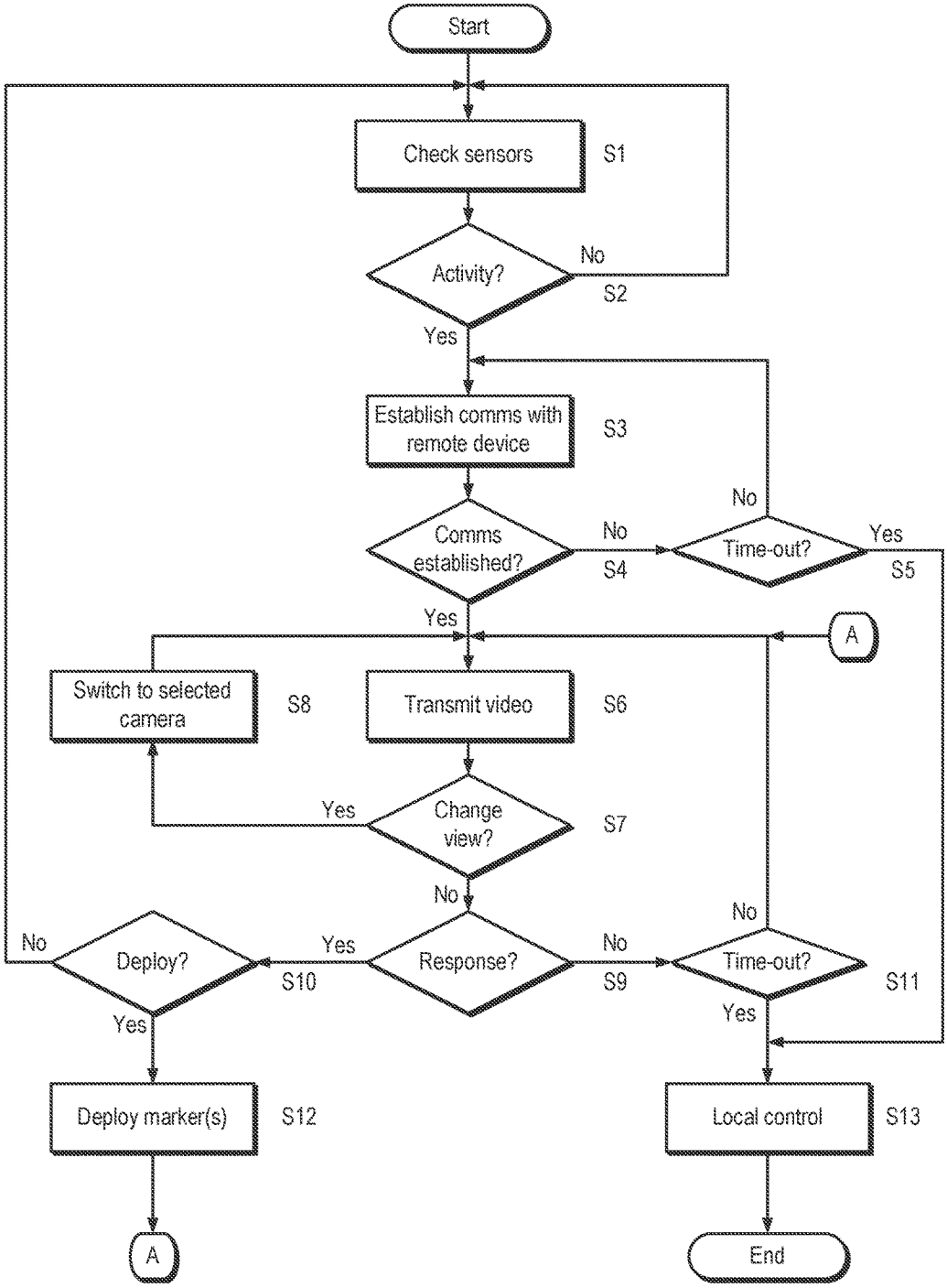
FIG. 2 shows a process flow diagram of a first method of operating a security marking system.

Of course, examples A, B and C represent only examples of the possible configurations of the security marking system 1, and many other possible arrangements can be used. For example, the security marking system 1 may include a proximity sensor 11 corresponding to each deployment device 3 and the sensor detection region 9 of each proximity sensor 11 may substantially overlap the respective marker deployment region 8. This may allow each deployment device 3 to be efficiently triggered during local control (step S13; FIG. 2). The proximity sensor 11 may be provided as a single unit with the deployment device 3.

Hub

The hub 2 for the security marking system 1 includes a deployment interface module 16, a sensor interface module 17, a controller 18, a network interface module 19 and storage 20.

The deployment interface module 16 in configured to communicate with the deployment devices 3 installed as part of the security marking system 1. The deployment interface module 16 may signal each deployment device 3 individually to activate and deploy marker liquid 7. In some examples, the deployment interface module 16 may also receive signals from the deployment devices 3 to notify the hub of events such as, for example, malfunctions or suspected tampering. The deployment interface module 16 may communicate with the marker deployment devices 3 using any suitable wired or wireless means such as, for example, Ethernet cable, USB cable, coaxial cable, fibre-optic cable, Wifi or other radio frequency signalling schemes. When a high density of sensors 4, deployment devices 3 or other smart/connected consumer articles are installed in a location, communications may be relayed using a mesh network using short range protocols such as, for example, Bluetooth® or ZigBee®. In security critical applications, communications between the hub 2 and deployment devices 3 and sensors 4 may be encrypted before transmission via the deployment interface 16 and sensor interface 17. This encryption would be encryption of the data to be transmitted and is in addition to any standard encryption measures applied using a specific communications protocol.

The sensor interface module 17 is configured to communicate with the sensors 4 installed as part of the security marking system 1. Some sensors 4 such as, for example the magnetic switch 12 or proximity/motion sensor 11 may only send signals when activity is detected. Other sensors 4, such as camera 10, may either send signals continuously, for example video, periodically, for example still images, or only when triggered by another sensor 4 or by a command transmitted by the sensor interface module 17. The sensor interface module 17 may also send commands to execute zoom, pan and/or rotation operations to sensors 4 in the form of cameras 10 which support some or all of such features. The sensor interface module may communicate with the sensors 4 using any suitable wired or wireless means, for example, the same or similar methods described in relation to the deployment interface module 16. 12. In some examples, the sensor interface module 17 may communicate with the sensor(s) 4 through a separate security alarm system (not shown) which controls the sensors 4.

The network interface 19 is configured to communicate with external networks 6 so that the hub 2 may communicate with the remote device 5. External networks 6 may include copper telephone networks, fibre networks, wireless mobile communication networks and the internet. The network interface 19 may connect directly to an external network 6, for example by direct connection to a telephone socket. Preferably, network interface 19 connects to a modem or gateway located at the installation site using wired or wireless connections. In order to provide security against tampering with telephone or other connections, the network interface 19 may optionally include a subscriber identity module (SIM) and an antenna to enable direct communications using mobile wireless networks using, for example, 3G, 4G or 5G. In security critical applications, communications between the hub 2 and the remote device 5 may be encrypted before transmission via the network interface 19 or from the remote device 5. This encryption would be encryption of the data to be transmitted and is in addition to any standard encryption measures applied using a specific communications protocol The controller 18 is configured to control the deployment interface module 16, sensor interface module 17 and network interface module 19. When the controller 18 receives a signal from the sensor interface 17 indicating that a sensor 4 has detected activity, the controller attempts to establish communication with the remote device 5 via network interface 19 and external networks 6. If communication with the remote device 5 cannot be established within a first time-out period, for example 5 to 60 seconds, or if communication with the remote device 5 is established but the connection bandwidth is insufficient to transmit a video signal, then the controller 18 will control all the connected deployment devices locally.

However, if communication with the remote device 5 can be established and the connection bandwidth is sufficient to transmit a video signal, then the controller 18 transmits to the remote device 5 a video signal showing at least part of a marker deployment region 8 corresponding to the activated sensor 4. In practice, the video signal is provided by the camera 10 which has a sensor detection area 9, i.e. a field of view, which overlaps with the sensor detection area 9 of the activated sensor 4 (where this is not the camera 10 itself). When several cameras 10 cover the sensor detection area 9 of the activated sensor 4, the closest camera 10 is selected to supply the video signal.

Subsequently, if the controller 18 receives via the network interface 19 a deployment signal (not shown) sent from the remote device, the controller 18 controls the deployment interface module 16 to activate one or more marker deployment devices designated by the deployment signal. In general, the property owner or responsible person may use the remote device 5 to activate multiple deployment devices 3 concurrently. Alternatively, the property owner or responsible person may use the remote device 5 to send a cancellation signal to the controller 18, in which case the controller 18 ceases transmission of the video signal. However, if no follow up signal from the remote device 5 is received within a second time-out period, for example 5 minutes, or if the connection bandwidth becoming insufficient to transmit a video signal for a duration exceeding the first time-out period, then the controller 18 will control all of the connected deployment devices 3 locally.

Storage 20 includes a log file 21 recording, for example, the dates and times that sensors 4 detect activity. Optionally, when activity is detected, the controller 18 may store recorded footage 22 to the storage 20 corresponding to video signals from cameras 10 which cover activated sensors 4 and encompassing at least periods corresponding to detected activity.

The hub 2 receives power from an external power supply 23, for example, mains electricity. Optionally, the hub 2 includes a battery 24 or similar short term power supply to allow the hub 2 to operate even if the external power supply 23 is interrupted, for example due to tampering or during a significant event such as a riot or natural disaster when property may be at an elevated risk. The hub may comprise a power indicator, optionally a light, to indicate if the device is on or off.

The hub may comprise a connection indicator, optionally a light, indicating if it is connected to the controller. If the hub is not connected to the controller then in one embodiment the deployment devices may be under local control. In another embodiment, the connection indicator may indicate that the hub is not connected to the controller and the deployment devices are inoperative, for example to allow maintenance or if a subscription for a monitoring service using the hub has expired.

First Method of Operating a Security Marking System

Referring also to FIG. 2, a first method of operating the security marking system 1 shall be explained.

The controller 18 checks whether any sensors 4 are reporting activity (step S1). If no sensors report activity (step S2; No), then the controller 18 continues to check the sensors 4. However, if the controller 18 has received a signal from a sensor 4 which has detected activity (step S2; yes), the controller 18 attempts to establish communication with the remote device 5 via the network interface 19 and external networks 6 (step S3).

If communication with the remote device 5 is not established, or if communication is established but the connection bandwidth is insufficient to transmit a video signal (step S4; No), the controller 18 checks whether a first time-out period, for example 5 to 60 seconds has elapsed (step S5). If the first time-out period has not elapsed (step S5; No), then the controller 18 continues trying to establish communications to the remote device 5 (steps S3, S4). If the first time-out period has elapsed (step S5; yes), the controller 18 operates all the deployment devices 3 connected to the security marking system 1 under local control (step S13).

If communication with the remote device 5 is established and the connection bandwidth is sufficient to transmit a video signal (step S4; yes), the controller 18 transmits a video signal to the remote device 5 which shows at least part of a marker deployment region 8 which overlaps with the sensor detection region 9 of the activated sensor 4 (step S6). The information as to which sensor detection regions 9 overlap which marker deployment regions 8 is predetermined during installation or modification of the system.

Subsequent procedures may depend upon the signals sent to the controller 18 by the property owner or responsible person operating the remote device 5. If the controller 18 receives a viewpoint change signal (step S7; Yes) from the remote device 5 designating a sensor 4 which is capable of transmitting video, i.e. camera 10 other than the current camera 10, then the controller 18 begins capturing video signals from the designated sensor 4, 10 (step S8) and transmits the new video signal to the remote device 5 (step S6). When any signal from the remote device 5 is received, a timer which is recorded and compared to a second time-out period (step S11) is reset.

When the security marking system 1 includes sensors 4 in the form of cameras 10 which are capable of performing pan, rotate or zoom operations, the viewpoint change signal from the remote device may, instead of designating a different camera, include one or more pan, rotate and/or zoom commands. In such a case, the controller 18 causes the sensor interface module 17 to transmit a command to the currently viewed camera 10 to execute any pan, rotate or zoom commands included in the viewpoint change signal.

The controller 18 checks whether a response has been received from the remote device 5 in the form of a deployment or cancellation signal (step S9). If no response has been received (step S9; no), the controller 18 checks whether a second time-out period, for example 5 minutes, has elapsed (Step S11). The controller 18 also checks that the connection bandwidth is still sufficient for transmitting a video signal. If the second time-out period has not elapsed and the connection bandwidth is sufficient (step S11; No), the controller 18 continues to transmit video to the remote device 5. If either the second time-out period has elapsed or the connection bandwidth has become insufficient (step S11; Yes), the controller 18 assumes local control of all deployment devices 3 connected to the security marking system 1.

However, if a response has been received (step S9; Yes), the type of response is checked by the controller 18 (step S10). If the response is a cancellation signal (step S10; no), then the controller 18 ceases transmitting the video signal to the remote device 5, breaks off communications and returns to the standby condition of checking the sensors 4 for activity (step S1).

If the response is a deployment signal (step S10; Yes), the controller 18 causes the deployment interface module 16 to activate one of more deployment devices 3 designated by the received deployment signal (step S12). After executing the deployment signal command, the controller 18 resumes transmitting video to the remote device 5, and the property owner or responsible person may continue to observe an intruder 14 and activate further deployment devices 3. Alternatively, the property owner or responsible person may disconnect or switch off the remote device 5 and thereby break the connection and turn the security marking system over to local control (steps S9, S11 and S13).

Local control of deployment devices 3 by the controller 18 includes, for each deployment device 3, if a signal from a sensor which has detected activity is received which corresponds to a sensor detection region 9 overlapping with or proximate to the marker deployment region 8 of the deployment device 3, then the controller 18 activates that deployment device 3 (step S13). The information as to which sensor detection regions 9 overlap with or are proximate to which marker deployment regions 8 is predetermined during installation or modification of the system. The controller 18 may continue local control (step S13) until the security marking system 1 is disarmed/switched off. Alternatively, if local control (step S13) was implemented because the remote device 5 could not initially be contacted, the controller 18 may periodically attempt to establish communication to the remote device whilst the sensors 4 continue to detect activity, and local control (step S13) may be stopped once video signal transmission is possible (step S6). When one or more deployment devices 3 correspond to deployment regions which only overlap with a camera 10 which is not capable of motion detection, and which do not overlap with and are not proximate to any other sensor detection volumes, such deployment devices 3 may be immediately activated upon switching to local control.

User Interface on the Remote Device

The remote device 5 may be any suitable data processing apparatus including display means and input means. For example, the remote device 5 may be a desktop or laptop computer, a mobile phone, tablet or similar device.

Figure 3:
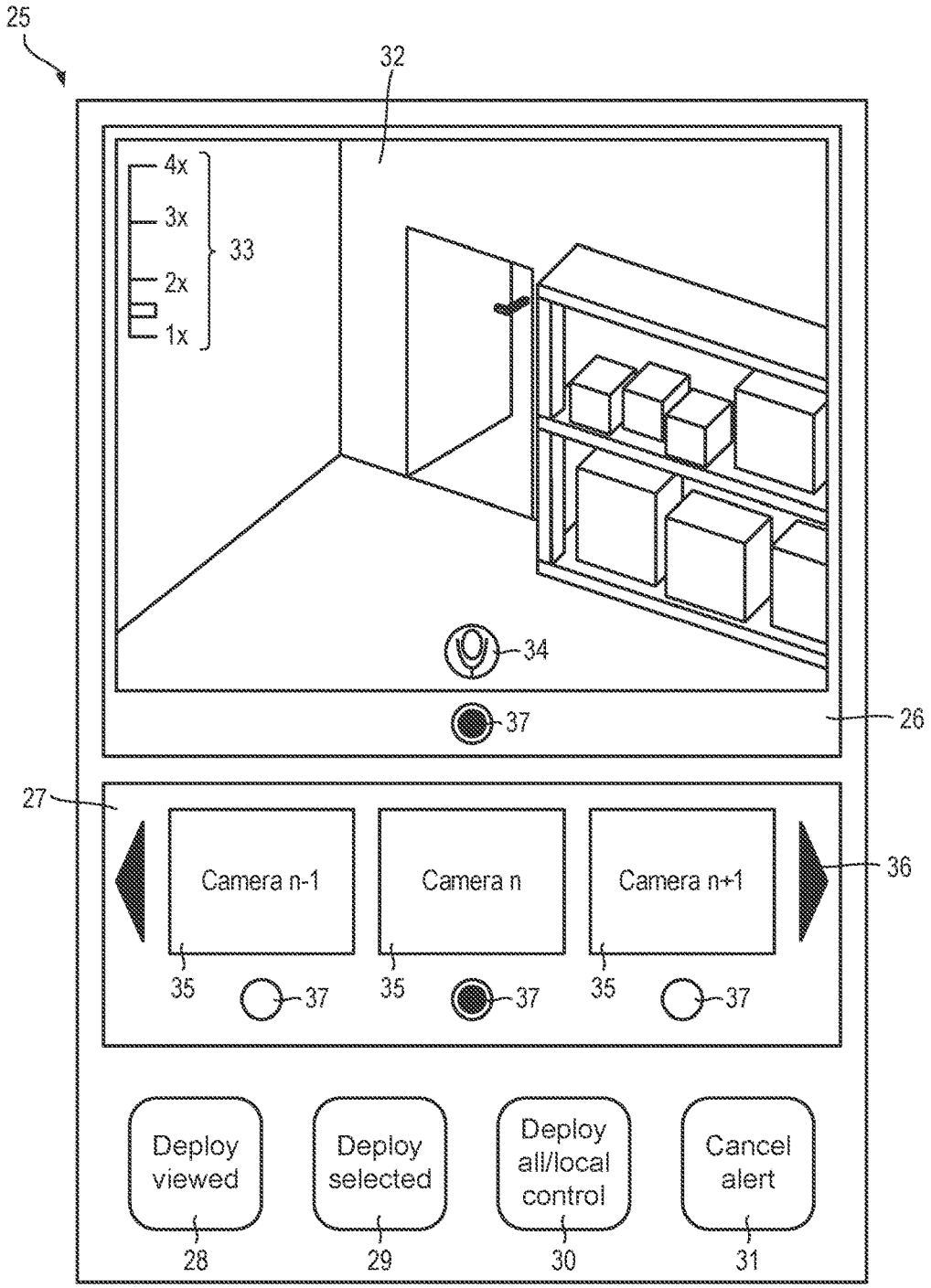
FIG. 3 shows an illustration of a software application running on a remote device.

Referring also to FIG. 3, a graphical user interface 25 displayed by the remote device 5 includes a main video panel 26, an alternative view selection panel 27 and action buttons 28, 29, 30, 31.

The main video panel 26 includes a view pane 32 showing the video signal from an active camera being transmitted from the hub 2. Superimposed on the view pane 32 are camera controls 33 for panning, zooming or rotating the view, if the active camera 10 supports such functions. In the example depicted, the active camera only supports zoom functions. When the camera controls 33 are used, the remote device 5 transmits a view change signal to the hub 2. Alternatively, when the remote device 5 has a touchscreen display, camera controls 33 may be replaced or supplemented using multi-touch gestures such as pinch to zoom, swiping and two-finger rotations etc.

If the security marking system 1 includes an audio output device within range of the active camera 10, then the main video panel 26 may also include a microphone icon 34 which the property owner or responsible person may activate to start audio transmission to the intruder 14. Audio transmission may include a recorded message and/or real-time audio from the property owner or responsible person. The knowledge that they are being watched and recorded, and that they themselves and/or goods or property within the building are being uniquely and indelibly marked may cause the intruder 14 to reconsider and leave immediately.

The alternative view selection panel 27 displays thumbnails 35 of other cameras 10 which are available to be viewed. The property owner or responsible person may select a different camera 10 to view by selecting the relevant thumbnail. When a thumbnail 35 is selected, the remote device 5 transmits a view change signal to the hub 2.

When large numbers of cameras 10, the alternative view selection panel 27 may include navigation buttons 36 to allow scrolling through the available cameras 10. Alternatively, when the remote device 5 has a touchscreen display, navigation buttons 36 may be replaced or supplemented using touch gestures such as swiping. Depending on the available bandwidth, the thumbnails 35 may be still images showing the field of view of the corresponding camera 10, or the thumbnails 35 may show low resolution video signals from the alternative cameras 10.

Activating the deploy viewed 28 action button will cause the remote device 5 to send a deployment signal designating the deployment device(s) 3 which correspond to the camera 10 providing the video signal for the view pane 32.

The view pane 32 and each of the thumbnails 35 each have a radio button or check-box 37 positioned just underneath. The property owner or responsible user may check as many of the radio buttons or check-boxes 37 as desired, and when the deploy selected 29 action button is pressed the remote device 5 will send a deployment signal to the hub 2 designating the deployment devices 3 corresponding to each selected/checked camera 10.

If the property owner or responsible user has seen enough or cannot find the intruder 14, they may activate the deploy all/local control 30 action button. This will send a signal to the hub 2 to cause all deployment devices 3 corresponding to a sensor 4 which can detect activity to be switched to local control and any deployment devices 3 which do not have a sensor 4 which can detect activity to activate immediately.

The cancel alert 31 action button causes the remote device 5 to send a cancellation signal to the hub 2.

The graphical user interface 25 is merely an example and many different specific designs, configurations and functions may be provided by similar or different graphical user interfaces running on the remote device 5.

Second Method of Operating a Security Marking System

Figure 4:
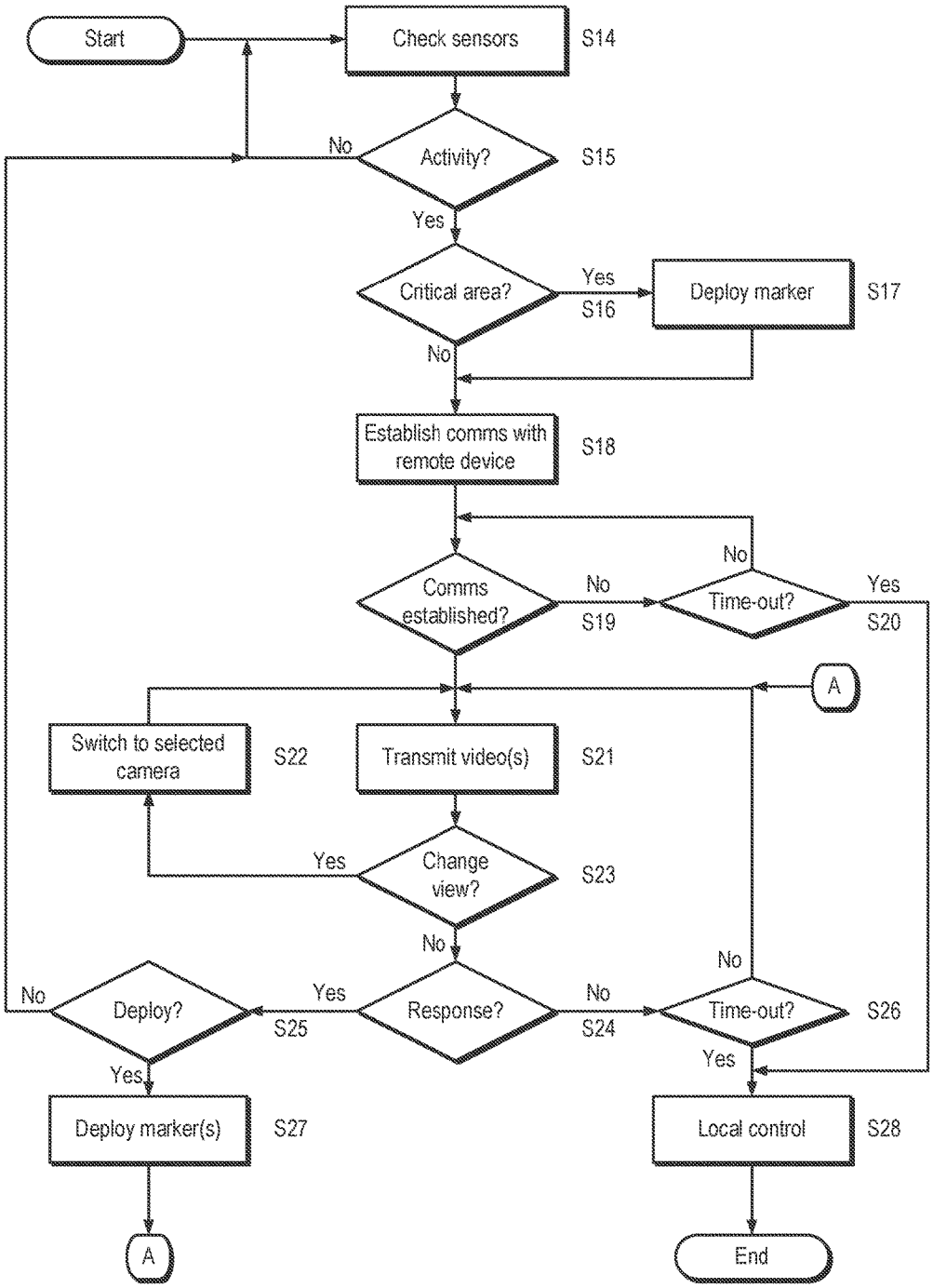
FIG. 4 shows a process flow diagram of a second method of operating a security marking system.

Referring also to FIG. 4, a second method of operating the security marking system 1 shall be explained.

In the second method a subset of deployment devices 3 are pre-designated as rapid activation deployment devices. For example, deployment devices 3 located in doorways or windows and linked to magnetic sensors 12 which send a signal when the door or window is opened or forced. Another example would be a deployment device 3 with a deployment region 8 which covers high value items such as a till, safe, cash machine or valuable possession 15. Any deployment device 3 linked to a sensor 4 which requires especially time critical activation may be designated as a rapid activation deployment device.

The controller 18 checks whether any sensors 4 are reporting activity (step S14). If no sensors report activity (step S15; No), then the controller 18 continues to check the sensors 4. However, if the controller 18 has received a signal from a sensor 4 which has detected activity (step S15; yes), the controller 18 checks whether the sensor 4 which has detected activity corresponds to a sensor detection region 9 overlapping with or proximate to the deployment region 8 of a deployment device 3 designated as a rapid activation deployment device 3 (step S16). If the activated sensor 4 corresponds to a rapid activation deployment device 3 (step S16; Yes), then that deployment device 3 is immediately activated (step S17) before attempting to establish communications to the remote device (step S18). If the activated sensor 4 does not correspond to a rapid activation deployment device 3 (step S16; No), the controller 18 attempts to establish communications with the remote device (step S18).

The subsequent steps (steps S18 to S28) are identical to steps of the first method (steps S3 to S13).

MODIFICATIONS

It will be appreciated that many modifications may be made to the embodiments hereinbefore described. Such modifications may involve equivalent and other features which are already known in the design, manufacture and use of property marking or security system and which may be used instead of or in addition to features already described herein. Features of one embodiment may be replaced or supplemented by features of another embodiment.

Components of the security marking system 1 such as, for example, the hub 2 and deployment devices 3, may installed on a leasehold/subscription basis. The hub 2 may be configured to periodically check the status of the lease or subscription with an external server (not shown) via the network interface 19. If the external server indicates that the lease or subscription has lapsed, or if the hub 2 is unable to contact the external server for an extended period, for example one month, then the hub 2 may be configured to render itself inoperable until the subscription or lease is renewed or connection to the external server is re-established.

The hub 2 may be configured to automatic notify the police, other responsible authorities or a private security firm that the system 1 has been detected activity via any communication method including SMS, voice message or email.

The deployment devices 3 may be configured to measure or meter the amount of marker liquid remaining in each deployment device 3 and to communicate this to the hub 2 via the deployment interface 16. The hub may be configured to send reminders to the property owner or responsible person and/or automatic orders to an external order server (not shown) for refills of marker liquid when a deployment device contains low or zero marker liquid 7. If the marker liquid 7 has a shelf life, the hub 2 may be configured to track the elapsed time since marker liquid 7 was refilled for each deployment device 3 and to send reminders and/or automatic orders as the shelf life approaches or expires.

The hub 2 may be configured to record information about power outages and/or battery conditions in the log file 21. The hub 2 may be configured to automatic notify the police, other responsible authorities or a private security firm in response to a failure or interruption of the external power supply 23.

The controller 18 of the hub 2 may be configured to periodically download and install updates from an external update server (not shown) via the network interface 19.

Although claims have been formulated in this application to particular combinations of features, it should be understood that the scope of the disclosure of the present invention also includes any novel features or any novel combination of features disclosed herein either explicitly or implicitly or any generalization thereof, whether or not it relates to the same invention as presently claimed in any claim and whether or not it mitigates any or all of the same technical problems as does the present invention. The applicant hereby gives notice that new claims may be formulated to such features and/or combinations of such features during the prosecution of the present application or of any further application derived therefrom.

The invention claimed is:

1. A method of security marking for a system which comprises a plurality of marker deployment devices, each marker deployment device for deploying a marker liquid in a corresponding deployment region, wherein a subset of marker deployment devices are pre-designated as rapid activation deployment devices, and one or more sensors, each sensor for detecting activity within a corresponding sensor detection region, wherein each marker deployment region overlaps one or more sensor detection regions at least partially, the overlapping one or more sensor detection regions corresponding to at least one sensor capable of transmitting video, and wherein the deployment region of each rapid activation deployment device overlaps with or is proximate to at least one sensor detection region corresponding to a sensor which is not capable of transmitting video, the method comprising:

receiving a signal from a sensor which has detected activity;

attempting to establish communication with a remote device;

in dependence upon communication with the remote device is established and connection bandwidth is sufficient to transmit a video signal:

transmitting a video signal to the remote device, the video signal showing at least part of a marker deployment region proximate to the activated sensor; and in dependence upon receiving a deployment signal from the remote device, activating one or more marker deployment devices designated by the deployment signal;

in dependence upon receiving a signal from a sensor which has detected activity and which corresponds to a marker deployment device designated as a rapid activation deployment device, activating that marker deployment device.

2. A method according to claim 1 further comprising:

in dependence upon communication with the remote device not being established within a first predetermined duration or communication being established and connection bandwidth being insufficient to transmit a video signal, operating all marker deployment devices according to local control.

3. A method according to claim 1 further comprising:

in dependence upon communication with the remote device is established and connection bandwidth is sufficient to transmit a video signal:

in dependence upon receiving no signal from the remote device within a second predetermined duration or upon the connection bandwidth becoming insufficient for longer than the first predetermined duration, operating all marker deployment devices according to local control.

4. A method according to claim 2, wherein local control comprises, for each marker deployment device, activating the marker deployment device in dependence upon receiving a signal from a sensor which has detected activity and which corresponds to a sensor region overlapping with or proximate to the marker deployment region.

5. A method according to claim 1 further comprising, in dependence upon communication with the remote device is established and connection bandwidth is sufficient to transmit a video signal, ceasing transmission of the video signal in dependence upon receiving a cancellation signal from the remote device.

6. A method according to claim 1, further comprising:

in dependence upon receiving a viewpoint change signal from the remote device designating a sensor which is capable of transmitting video, transmitting the video signal from the designated sensor to the remote device.

7. A method according to claim 1, wherein the system comprises a proximity sensor corresponding to each marker deployment device and the sensor detection region of each proximity sensor overlaps the respective marker deployment region.

8. A method according to claim 1, wherein each sensor may comprise one or more of a camera, a proximity sensor, a motion sensor, an infra-red sensor, a pyroelectric sensor, an acoustic sensor, an ultrasonic sensor, a magnetic switch, a pressure switch and/or a mechanical switch.

9. A method according to claim 1, wherein the system comprises at least one audio output device, the method further comprising:

receiving an audio signal from the remote device; and playing the audio signal through the at least one audio output device.

10. A hub for a security marking system comprising:

a deployment interface module configured to communicate with a plurality of marker deployment devices, each marker deployment device for deploying a marker liquid in a corresponding deployment region;

a sensor interface module configured to communicate with one or more sensors, each sensor for detecting activity within a corresponding sensor detection region;

a network interface configured to communicate with external networks; and a controller configured to control the sensor interface, marker interface and network interface;

wherein each marker deployment region overlaps one or more sensor detection regions at least partially and wherein for each marker deployment region the overlapping one or more sensor detection regions include at least one sensor detection region corresponding to a sensor capable of transmitting video;

wherein the controller is configured to:

store the identities of a subset of marker deployment devices which are pre-designated as rapid activation deployment devices, wherein the deployment region of each rapid deployment device overlaps with or is proximate to at least one sensor detection region corresponding to a sensor which is not capable of transmitting video;

receive a signal indicating that a sensor has detected activity;

attempt to establish communication with a remote device;

in dependence upon communication with the remote device being established and connection bandwidth is sufficient to transmit a video signal:

transmit a video signal to the remote device, the video signal showing at least part of a marker deployment region proximate to the activated sensor; and in dependence upon receiving a deployment signal from the remote device, activate one or more marker deployment devices designated by the deployment signal;

in dependence upon receiving a signal from a sensor that has detected activity and which corresponds to a marker deployment device designated as a rapid activation deployment device, to activate that marker deployment device.

11. A hub according to claim 10 wherein the controller is configured, in dependence upon communication with the remote device not being established within a first predetermined duration or communication being established and connection bandwidth being insufficient to transmit a video signal, to operate all marker deployment devices according to local control.

12. A hub according to claim 10 wherein the controller is configured, in dependence upon communication with the remote device is established and connection bandwidth is sufficient to transmit a video signal; and in dependence upon receiving no signal from the remote device within a second predetermined duration or upon the connection bandwidth becoming insufficient for longer than the first predetermined duration, to operate all marker deployment devices according to local control.

13. A hub for a security marking system according to claim 11, wherein when marker deployment devices are under local control, the controller is configured to, for each marker deployment device:

in dependence upon receiving a signal from a sensor which has detected activity and which corresponds to a sensor region overlapping with or proximate to the marker deployment region, to activate the marker deployment device.

14. A hub according to claim 10 wherein the controller is configured, in dependence upon communication with the remote device being established and connection bandwidth being sufficient to transmit a video signal, to cease transmission of the video signal in dependence upon receiving a cancellation signal from the remote device.

15. A hub for a security marking system according to claim 10, further comprising:

a battery for providing power when an external power supply is unavailable.

16. A hub for a security marking system according to claim 10, wherein the sensor interface module communicates with some or all of the sensor(s) through a security alarm system which controls and/or monitors some or all of the sensors.

17. A security marking system comprising:

a hub for a security marking system comprising:

a deployment interface module configured to communicate with a plurality of marker deployment devices, each marker deployment device for deploying a marker liquid in a corresponding deployment region;

a sensor interface module configured to communicate with one or more sensors, each sensor for detecting activity within a corresponding sensor detection region;

a network interface configured to communicate with external networks; and a controller configured to control the sensor interface, marker interface and network interface;

wherein each marker deployment region overlaps one or more sensor detection regions at least partially and wherein for each marker deployment region the overlapping one or more sensor detection regions include at least one sensor detection region corresponding to a sensor capable of transmitting video;

wherein the controller is configured to:

store the identities of a subset of marker deployment devices which are pre-designated as rapid activation deployment devices, wherein the deployment region of each rapid deployment device overlaps with or is proximate to at least one sensor detection region corresponding to a sensor which is not capable of transmitting video;

receive a signal indicating that a sensor has detected activity;

attempt to establish communication with a remote device;

in dependence upon communication with the remote device being established and connection bandwidth is sufficient to transmit a video signal:

transmit a video signal to the remote device, the video signal showing at least part of a marker deployment region proximate to the activated sensor; and in dependence upon receiving a deployment signal from the remote device, activate one or more marker deployment devices designated by the deployment signal;

in dependence upon receiving a signal from a sensor that has detected activity and which corresponds to a marker deployment device designated as a rapid activation deployment device, to activate that marker deployment device;

one or more marker deployment devices, each marker deployment device for deploying a marker liquid in a corresponding deployment region; and one or more sensors, each sensor for detecting activity within a corresponding sensor detection region;

wherein each marker deployment region overlaps one or more sensor detection regions at least partially, and wherein for each marker deployment region the overlapping one or more sensor detection regions include at least one sensor detection region corresponding to a sensor capable of transmitting video.

18. A security marking system according to claim 17, wherein a sensor may comprise one or more of a camera, a proximity sensor, an infra-red sensor, a pyroelectric detector, an acoustic detector, an ultrasonic detector, a magnetic switch, a pressure switch and/or a mechanical switch.

19. A security marking system according to claim 17, further comprising at least one audio output device.

20. A non-transitory computer readable medium storing instructions which, when executed by a data processing apparatus, cause the data processing apparatus to carry out a method for security marking for a system, the method comprising:

receiving a signal from a sensor which has detected activity;

attempting to establish communication with a remote device;

in dependence upon communication with the remote device is established and connection bandwidth is sufficient to transmit a video signal:

transmitting a video signal to the remote device, the video signal showing at least part of a marker deployment region proximate to the activated sensor; and in dependence upon receiving a deployment signal from the remote device, activating one or more marker deployment devices designated by the deployment signal;

in dependence upon receiving a signal from a sensor which has detected activity and which corresponds to a marker deployment device designated as a rapid activation deployment device, activating that marker deployment device, wherein the system comprises a plurality of marker deployment devices, each marker deployment device for deploying a marker liquid in a corresponding deployment region, wherein a subset of marker deployment devices are predesignated as rapid activation deployment devices, and one or more sensors, each sensor for detecting activity within a corresponding sensor detection region, wherein each marker deployment region overlaps one or more sensor detection regions at least partially, the overlapping one or more sensor detection regions corresponding to at least one sensor capable of transmitting video, and wherein the deployment region of each rapid activation deployment device overlaps with or is proximate to at least one sensor detection region corresponding to a sensor which is not capable of transmitting video.

* * * * *